US005403553A

United States Patent [19]

Heinonen

[11] Patent Number: 5,403,553

[45] Date of Patent: Apr. 4, 1995

[54] JET PART PIPETTE

[75] Inventor: Mauno Heinonen, Vantaa, Finland

[73] Assignee: Labsystems Oy, Helsinki, Finland

[21] Appl. No.: 45,535

[22] Filed: Apr. 9, 1993

[30] Foreign Application Priority Data

Apr. 13, 1992 [FI] Finland ..... 921647

[51] Int. Cl.[6] ..... B01L 3/02

[52] U.S. Cl. ..... 422/100; 73/864.13; 73/864.14; 73/864.16

[58] Field of Search ..... 73/864.14, 864.13, 864.16; 422/100

[56] References Cited

U.S. PATENT DOCUMENTS

| | | | |
|---|---|---|---|
| 3,810,391 | 4/1971 | Suovaniemi | 73/864.18 |
| 3,991,617 | 11/1976 | Marteau d'Autry | 73/864.14 |
| 4,009,611 | 3/1977 | Koffer et al. | 73/864.14 |
| 4,054,062 | 10/1977 | Branham | 73/864.14 |
| 4,099,548 | 7/1978 | Sturm et al. | 73/864.14 X |
| 4,151,750 | 5/1979 | Suovaniemi et al. | 73/864.14 |
| 4,187,724 | 2/1980 | Citrin | 73/864.14 |
| 4,261,205 | 4/1981 | Oshikubo et al. | 73/864.14 |
| 4,283,950 | 8/1981 | Tervamäki | 73/864.14 |
| 4,418,580 | 12/1983 | Satchell et al. | 73/864.14 X |
| 4,554,134 | 11/1985 | Tervamäki et al. | 422/100 |
| 4,567,780 | 2/1986 | Oppenlander et al. | 422/100 X |
| 4,616,514 | 10/1986 | Magnussen, Jr. et al. | 73/864.14 |
| 4,671,123 | 6/1987 | Magnussen et al. | 73/864.14 X |
| 4,933,148 | 6/1990 | Perlman | 422/100 |
| 5,192,511 | 5/1993 | Roach | 73/864.14 X |

FOREIGN PATENT DOCUMENTS

| | | |
|---|---|---|
| 1431477 | 4/1965 | France . |
| 4-150862 | 9/1992 | Japan . |
| 2161398 | 7/1984 | United Kingdom . |

*Primary Examiner*—Donald E. Czaja
*Assistant Examiner*—Milton I. Cano
*Attorney, Agent, or Firm*—Armstong, Westerman, Hattori, McLeland & Naughton

[57] ABSTRACT

A jet part pipette includes a body having an upper end and a lower end, the body having a longitudinal opening therein. A jet part is connected at the lower end of the body, and has an upper portion and a lower end. A replaceable jet container is connected to the lower end of the jet part, and has a lower element having a longitudinal opening therein. A movable rod extends through the jet part and through the longitudinal opening in the body, and has a manually operable upper end and a lower end engaging the lower element of the replaceable jet container for drawing liquid therein. A replaceable cover surrounds the upper portion of the jet part, and has a first end portion and a second end portion, the first end portion of the replaceable cover being detachably connected to an outer periphery of the upper portion of the jet part. The lower end of the jet part extends beyond the second end of the replaceable cover. Continued actuation of the movable rod toward the replaceable jet container while the lower end of the movable rod is in engagement with the replaceable jet container, causes removal of the replaceable jet container from the lower end of the jet part.

8 Claims, 1 Drawing Sheet

JET PART PIPETTE

FIELD OF INVENTION

The invention relates to pipettes having a jet part, into the jet of whose lower part a liquid is drawn.

PRIOR ART

Pipettes to be used for dosing liquids are known, which have a jet part to be inserted into a vessel, such as a test tube, and at the end of the jet part a plastic container, into which the liquid to be dosed is drawn by means of a piston in the pipette. The container is replaceable, so that a new, clean container can always be used for a new dose. Such a pipette is described e.g. in the publication FI-47461 (which corresponds to the publication U.S. Pat. No. 3,810,391).

Pipettes of the type described above are also known, which have a mechanism, by means of which the jet container may be removed without touching it manually. These have a removal sleeve sliding on the jet part of the pipette and as an extension thereto an arm, which, when pressed, pushes the container off. Such pipettes are described e.g. in the publication FR-2287941 (which corresponds to the publication U.S. Pat. No. 3,991,617), U.S. Pat. No. 4,009,611 as well as FI-57540 (which corresponds to the publication U.S. Pat. No. 4,151,750).

In so-called displacement pipettes, a piston is also positioned in the jet container, whereby the jet part of the pipette has correspondingly also an arm, by means of which the piston head is gripped. In this way, e.g. a contamination possibly caused by the piston is also prevented. Such a pipette is described e.g. in the publication U.S. Pat. No. 4,567,780.

GENERAL DESCRIPTION OF INVENTION

The object of the invention is to provide a pipette, in which the risk of contamination has further been reduced. This is achieved by means of features described in the patent claims.

In accordance with the invention, around the jet part of the pipette, above the jet container is used a cover, which can always be replaced by a clean one, when so desired. In this way, it is possible to prevent e.g. the entry of molecules adhering to the jet part of the pipette from the inner wall of a test tube into a wrong sample in connection with the next injection. The pipette is applicable to be used especially in operations related to the use of a so-called polymerase chain reaction, in which even one molecular chain may contaminate the sample.

The pipette is most preferably a displacement pipette, in which the piston is replaced together with the jet container.

The cover is most preferably a sleeve. The sleeve is fixed to the jet part best by friction. The pipette includes most preferably also a cover removal mechanism, by means of which the cover may be removed without touching it manually.

DETAILED DESCRIPTION OF INVENTION

Figure 2:
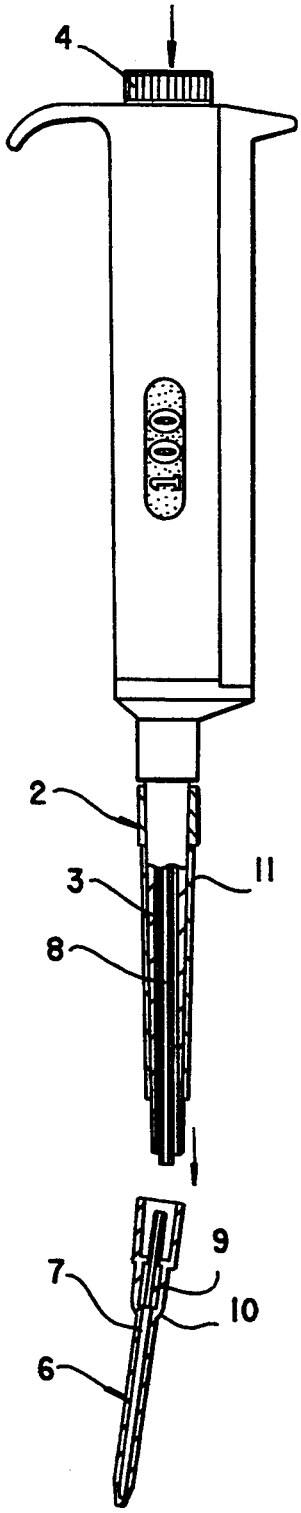
FIG. 2 is a side elevational view of a displacement pipette according to the present invention with a detachable jet container removed from a main body portion of the pipette.
Figure 3:
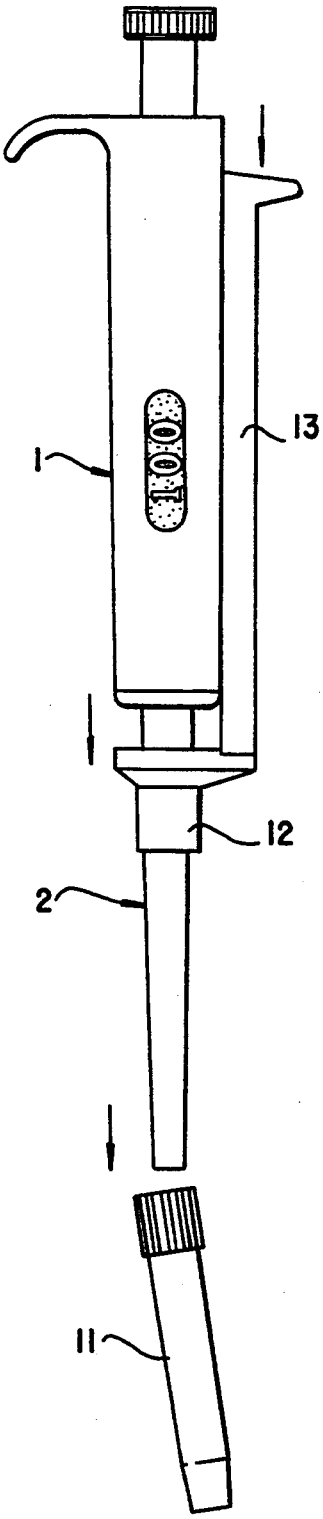
FIG. 3 is a side elevational view of a displacement pipette according to the present invention with a cover and detachable jet container removed from a main body portion of the pipette.

Some applications of the invention are next described in more detail. In the drawings of the description, FIGS. 1–3 show one displacement pipette in accordance with the invention in different steps of the pipette operation.

The pipette in accordance with the invention has a handle 1 and at its lower end a narrower, round, downwardly slightly tapered jet part 2 (FIG. 3), which form the body of the pipette. Inside the body is located a longitudinal movable piston rod 3 (FIG. 2), whose upper end extends above the upper end of the handle 1 as a push button 4.

The pipette according to the figures has a volume control mechanism, by means of which the stroke of the piston rod 3 may be changed by turning the button 4. The corresponding volume is shown by numerals on a display 5 (FIG. 1). A corresponding volume control mechanism is described e.g. in the publication FI-64752 (which corresponds to the publication U.S. Pat. No. 4,554,134).

Figure 1:
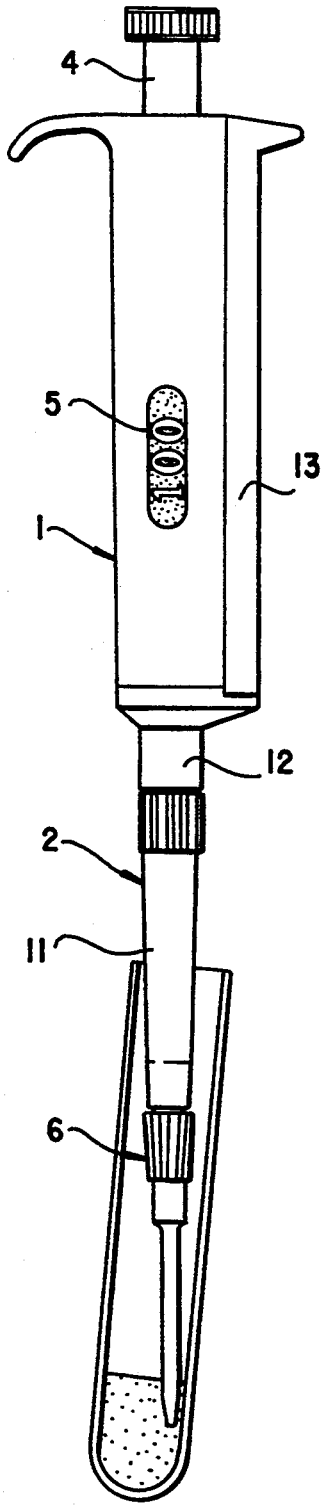
FIG. 1 is a side elevational view of a displacement pipette according to the present invention shown as being inserted in a schematically illustrated test tube.

At the lower end of the jet part 2 is located a detachable jet container 6, into which the liquid to be injected is drawn (FIG. 1). The upper end of the jet container 6 is conical and fitted to be placed by means of friction tightly on the jet part 2.

The pipette according to the figures is a displacement pipette, in which a piston 7 is always replaced together with the jet container 6.

Before pipetting, the lower end of the jet part 2 is pushed tightly into the upper end of the jet container 6. At the same time, the button 4 is pressed to such an extent that the piston rod 3 inside the jet part 2 grips the upper end of the piston 7 of the jet container 6. The piston rod 3 is a sleeve, which grips the head of the piston 7 from around it. When the button 4 is released, the piston rod 3 rises up by a controlled distance by the action of the spring placed in the handle 1 and the piston 7 draws a predetermined amount of liquid into the container 6. Similarly, the liquid is dosed off the container 6 by pressing the button 4 to such an extent that the piston 7 contacts the bottom of the jet container 6. When it is necessary to disengage the container 6 and the piston 7 from the jet part 2, the button 4 is pressed into a still lower position, whereby a pin 8 inside the piston rod 3 pushes the container 6 and its piston 7 off the jet part. For facilitating the removal, the piston is also provided with an extension 9, which contacts a reduction 10 of the container 6 in the removal step.

In an air displacement pipette, the piston is correspondingly located inside the jet part, whereby the jet container includes only a container piece.

Especially in the case, when liquid is drawn from long test tubes, a contaminant may stick to the jet part 2. This contaminant may then subsequently transfer to the doses to be pipetted, e.g. via a wall of another test tube. Especially in connection with polymerase chain reaction operations, it has to be ensured that no foreign reactive molecules can enter into the reaction.

For preventing the contamination, a cover 11 is placed on the jet part 2. The cover 11 is a conical sleeve separate from the jet container and engages with the jet part 2 by means of friction. Thus, it is not necessary to use the cover 11 in connection with every pipetting.

Furthermore, the cover 11 does not fall by itself, when the jet container is removed. In this way, it is easy to replace it with a new one only when so desired. The pipette also includes a removal mechanism for the cover 11. It comprises a sleeve-like remover 12 sliding on the surface of the jet part 2 and as an extension thereto an arm 13 on the side of the handle 1. When the arm 13 is pressed, the remover 12 pushes the cover 11 off the jet part 2 (FIG. 3).

The arm 13 is fitted by means of a T-groove joint onto the surface of the handle 1. In addition, there is a spring inside the arm 13, which spring tends to keep the arm in its upper position. The structure is analogous with a jet-container removal mechanism described e.g. in the publication FI-57540 (which corresponds to the publication U.S. Pat. No. 4,151,750).

In an air displacement pipette, wherein the jet container has no piston, the removal mechanism simultaneously disengages both the cover and the jet container.

The cover is most preferably made of a suitable plastic material by injection moulding.

The cover in accordance with the invention is easy to use. The jet containers are generally in a vertical position on a special stand, on which they are gripped by means of the jet part of the pipette. The covers may be placed on their own stand adjacent to the jet containers, whereby a cover is first picked up for the jet part and immediately thereafter a jet container.

A fairly wide sleeve-like cover is also easy to manufacture by means of a conventional injection moulding technique.

In principle, the cover could also be a sleeve positioned loosely on the jet part and arranged as an extension for the upper end of the jet container. Much more material is then consumed, since the same cover cannot be used together with several containers.

In principle, the jet container and the cover may also be packed on the stand on top of each other such that they may engage with the pipette by one movement. However, the stand may then become uncomfortably high.

I claim:

1. A jet part pipette, comprising:

a pipette body having an upper end and a lower end, said body having a longitudinal opening therein;

a jet part connected at said lower end of said body, said jet part having an upper portion and a lower end;

a replaceable jet container comprising a pipette tip connected to said lower end of said jet part, said replaceable jet container having a piston having a longitudinal opening therein;

a movable rod extending through said jet part and through said longitudinal opening in said body, said movable rod having a manually operable upper end and a lower end engaging said piston of said replaceable jet container for drawing liquid therein; and a replaceable cover surrounding said upper portion of said jet part, said replaceable cover having a first end portion and a second end portion, said first end portion of said replaceable cover being detachably connected to an outer periphery of said upper portion of said jet part, said lower end of said jet part extending beyond said second end of said replaceable cover;

wherein continued actuation of said movable rod toward said replaceable jet container while said lower end of said movable rod is in engagement with said replaceable jet container, causes removal of said replaceable jet container from said lower end of said jet part.

2. A pipette according to claim 1, wherein said cover is a cover spaced from said jet container and located above said jet container.

3. A pipette according to claim 1, wherein said cover is an annularly-shaped member.

4. A pipette according to claim 1, wherein said cover is a cover gripping said jet part by means of friction.

5. A pipette according to claim 4, wherein said pipette has a removal mechanism for pushing said cover off said jet part.

6. A pipette according to claim 5, wherein said cover is a cover spaced from said jet container, said pipette has a jet-container removal mechanism for pushing said jet container off said jet part and said cover removal mechanism is a removal mechanism separate from said jet-container removal mechanism.

7. A pipette according to claim 1, wherein said piston is a piston replaceable together with said jet container, and wherein said rod is a sleeve gripping said head of said piston.

8. A pipette according to claim 7, wherein said jet-container removal mechanism includes a pin movable inside said rod for pushing said piston off said rod.

* * * * *